United States Patent [19]

Rommen et al.

[11] 4,059,002

[45] Nov. 22, 1977

[54] MULTI-ROLL ROLLING MILL STAND

[75] Inventors: Hans Rommen; Erich Stoy, both of Dusseldorf, Germany

[73] Assignee: Schloemann- Siemag Aktiengesellschaft, Dusseldorf, Germany

[21] Appl. No.: 734,040

[22] Filed: Oct. 20, 1976

[51] Int. Cl.[2] ..... B21B 13/02; B21B 31/08

[52] U.S. Cl. ..... 72/238; 72/242; 72/245

[58] Field of Search ..... 72/245, 238, 241, 242, 72/243, 237

[56] References Cited

U.S. PATENT DOCUMENTS

| | | | |
|---|---|---|---|
| 2,677,978 | 5/1954 | Dahlstrom | 72/245 X |
| 3,724,252 | 4/1973 | Baker et al. | 72/241 |

*Primary Examiner*—Milton S. Mehr
*Attorney, Agent, or Firm*—Holman & Stern

[57] ABSTRACT

In a four-high rolling mill stand where the work rolls are offset from the perpendicular axial plane of the back-up rolls, they are supported on one side by intermediate rolls and support rollers, and on the other side by hydraulic piston/cylinder units. The work roll bearings are attached to the piston/cylinder units through a sliding guide arrangement, so that they can be slid up and down, from side to side, and the work rolls can also be moved towards and away from the roll gap by actuation of the piston/cylinder units.

6 Claims, 2 Drawing Figures

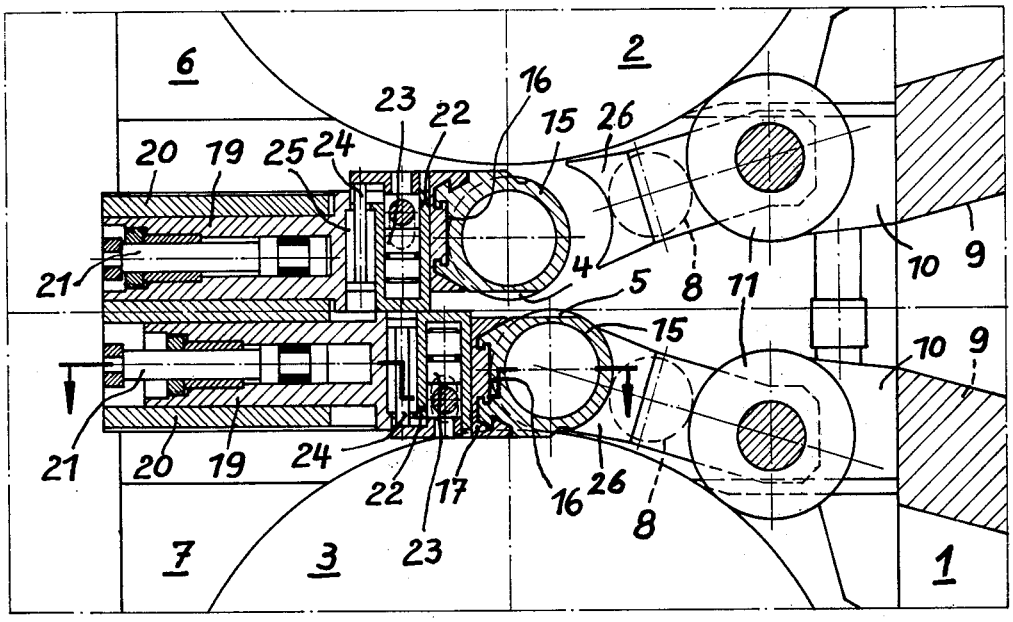
Fig. 1
Fig. 2
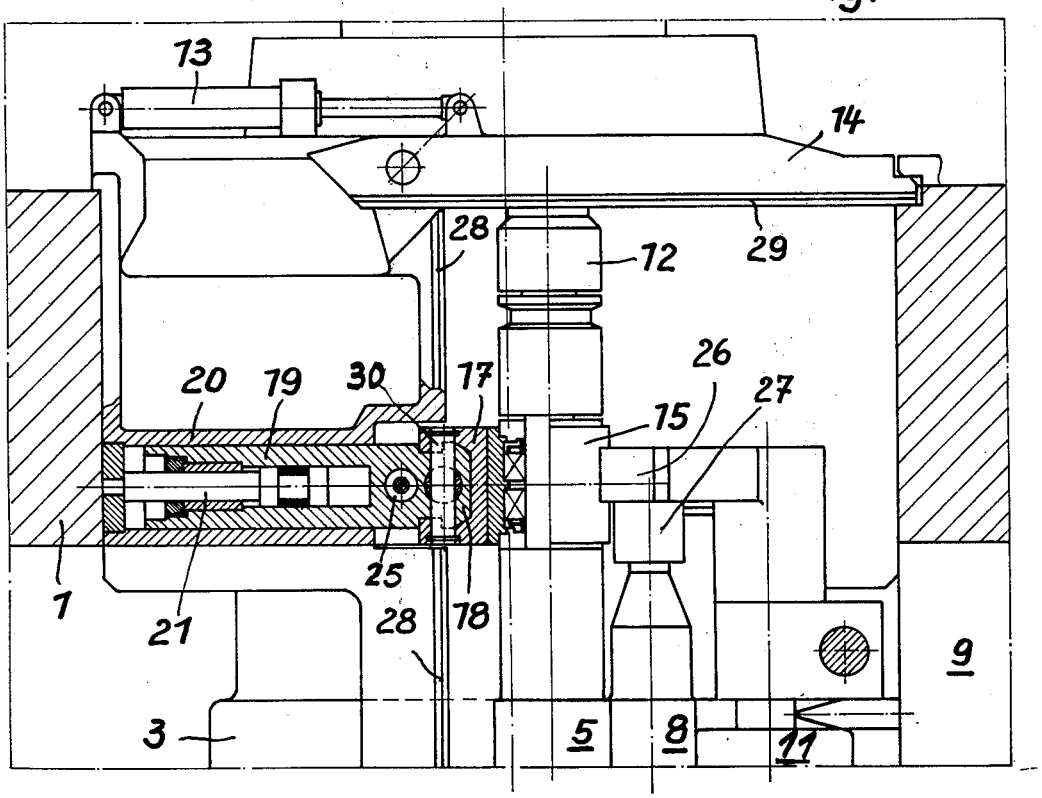

MULTI-ROLL ROLLING MILL STAND

BACKGROUND OF THE INVENTION

The invention relates to a multi-roll stand with two driven back-up rolls and work rolls which are entrained by frictional engagement with the back-up rolls and are horizontally supported in a position offset from the perpendicular axial plane of the back-up rolls and whose barrels are supported in the direction of the offset by intermediate rolls and by support rollers, supported on bridge members, and the side of the work roll bearings which is distal with respect to the support rollers is acted on by a thrust device to maintain the work rolls in contact with the bof the support rollers and bridge members and, depending on pitch and relative position, provide positive or negative support, along an arcuate line, for the bearings of the support rollers (German Offenlegungsschrift No. 1,777,054).

The prior art also discloses a rolling mill in which a variable curved support for the work rolls is provided by the combination of hydraulically biased bridge members which devices for flexing the axis of the support rollers (German Offenlegungsschrift No. 2,324,040).

A high mechanical and hydraulic effort is necessary in such known rolling mills in which the work rolls are forced against the arcuate support rollers and are thus curved, since the entire lateral support system must be flexed or reset.

Another disadvantage of known rolling mills is due to the fact that when producing a horizontal flexure of the work rolls, a corrective flexure is necessary in the vertical direction which is produced by resetting the support plane by an amount of only approximately one-twentieth of the horizontal work roll flexure.

It is also a disadvantage that the position of the work rolls becomes uncertain when the claws are released, thus preventing the use of automatic roll changing devices.

The invention seeks to avoid the disadvantage of known rolling mills. The object of the invention is more particularly to produce a multi-roll stand with a simple and more effective barrelling correction device. Furthermore, it should be possible by these means to set the working rolls into a defined roll changing position.

SUMMARY OF THE INVENTION

According to the invention, there is provided a multi-roll rolling mill stand comprising

- a housing;
- two driven back-up rolls;
- two work rolls each driven by frictional engagement with a respective one of the back-up rolls and which are offset from the perpendicular axial plane of the back-up rolls;
- a roll gap formed between the work rolls;
- bearings mounting the ends of the work rolls;
- intermediate rolls and support rollers supporting the work rolls on one side of the work roll gap;
- thrust devices supporting the work roll bearings on the other side of the roll gap; and
- a sliding guide arrangement by means of which the bearings are connected to the thrust devices so that the work roll bearings can slide both vertically relative to the back-up rolls and horizontally parallel to the back-up roll axes and so that the work rolls can be moved horizontally by the thrust devices towards and away from the intermediate rolls.

Since the adjustment of the work roll bearings to effect correction of the barrel acts vertically against the back-up rolls, it follows that the work roll flexure will be dependent on this adjusting motion. The adjusting travel and adjusting forces required to this end are therefore substantially less than in known multi-roll stands. Accordingly, the position of the working rolls can be determined at any time.

Hydraulic jacks may be vertically arranged in slides forming part of the guide arrangement with their pistons connected to the bearing holders. A compression spring column which is connected to the piston of the vertical jack and to the bearing holder can additionally be located in a vertical bore in the slides. The said compression spring column functions as a system safety device if the vertical jack is unpressurized.

In a particularly advantageous embodiment, the thrust devices are constructed as differential jacks whose plungers are secured on the housing frame. The stand need therefore only be provided with one set of centring devices and it is not necessary to make available separate devices for each chock.

The horizontal and vertical regulating motion of the work rolls can be defined with guide means situated between the roll housings and on the roll changing side thereof, with the axial guidance of the bearing holders in flush alignment. This defines the position of the work rolls in the course of roll changing and permits automation of this procedure. The axial guiding means for the bearing holders can be advantageously continued on the roll changing side of the roll stand by means of a pivotable bearing flap.

BRIEF DESCRIPTION OF THE DRAWINGS

One embodiment of the invention is illustrated in the accompanying drawing, in which:

FIG. 1 is a sectional view of a top and bottom work roll centring device in a multi-roll stand and FIG. 2 is a plan view of FIG. 1 along the line II—II in FIG. 1.

DESCRIPTION OF THE PREFERRED EMBODIMENT

Back-up rolls 2, 3 are supported in chocks 6, 7 to give vertical support of work rolls 4, 5 in the roll opening of a roll housing 1 of a multi-roll stand. The barrels of the work rolls 4, 5 are supported by intermediate rolls 8 and by support rollers 11 which are arranged on bridge members 9 with bearing plates 10. The work rolls 4, 5 are provided with axial bearings 12 which are retained by a flap 14 adapted for pivoting by means of a hydraulic cylinder 13.

Each work roll 4, 5 is also provided with radial bearings the outer races of which are guided in axially parallel configuration by means of a T-slot 16 on a bearing holder 17. The bearing holders 17 are in turn vertically guided by means of a T-slot on a T-guide 18 situated on the endface of a differential piston/cylinder unit 19. The differential units 19 are retained between guides 20, secured to the housing sides, opposite to the bridge members 10 so as to be horizontally slidable. The pistons 21 in the differential units 19 are also mounted on the housing sides. Cylinders 22, in which pistons 23 are connected through a stub shaft 30 to a bearing holder 17, are arranged vertically in the differential cylinders 19 in the region of the T-guides 18. To secure the position of the bearing holders 17 when the jacks formed by cylinders 22 and pistons 23 are unpressurized, the bearing holders 17 are provided with compression spring columns 24 which are retained in bores 25 that extend parallel with the jacks.

By biasing the differential piston/cylinder units 19 the work rolls 4, 5 are moved into the rolling position shown at the bottom of FIG. 1. The centring pieces 26, on which the bearings 27 of the intermediate rolls 8 are disposed, bear against the outer races 15 of the work roll bearings and centre the intermediate rolls 8 with respect to the work rolls 4, 5 and with respect to the support rollers 11. To apply correction to the barrel the jacks 22 are biased as a result of which the bearing holders 17 and therefore the journal necks of the work rolls 4, 5 are forced towards their respective back-up roll, 2 or 3. The cambered work rolls 4, 5 are thus directly flexed so as to effect correction of the barrelling.

To change the rolls the differential jack units 19 are biased in the opposite direction so that the said work rolls 4 assume the roll-changing position shown at the top of FIG. 1 in which said position the T-slot 16 of the outer races 15 of the bearings is in flush alignment with a T-guide 28. When changing a roll, the flap 14 is pivoted by cylinder 13 through 90°, so that its track 29 lines up with track 28, and the work roll 5 can be slid right out of the stand.

We claim:

1. A multi-roll rolling mill stand comprising:

a housing;

two driven back-up rolls;

two work rolls each driven by frictional engagement with a respective one of the back-up rolls and which are offset from the perpendicular axial plane of the back-up rolls;

a roll gap formed between the work rolls;

bearings mounting the ends of the work rolls;

intermediate rolls and support rollers supporting the work rolls on one side of the work roll gap;

thrust devices supporting the work roll bearings on the other side of the roll gap; and a sliding guide arrangement by means of which the bearings are connected to the thrust devices so that the work roll bearings can slide both vertically relative to the back-up rolls and horizontally parallel to the back-up roll axes and so that the work rolls can be moved horizontally by the thrust devices towards and away from the intermediate rolls.

2. A stand as claimed in claim 1, wherein the sliding guide arrangement includes vertically-acting hydraulic jacks for sliding the work roll bearings vertically relative to the back-up rolls.

3. A stand as claimed in claim 2, wherein the sliding guide arrangement also includes a vertically-acting compression spring which biasses the work roll bearings vertically relative to the back-up rolls, when the hydraulic jacks are inactive.

4. A stand as claimed in claim 1, wherein the thrust devices are differential piston/cylinder units and the pistons are secured to the housing.

5. A stand as claimed in claim 1, wherein the sliding guide arrangement includes stop abutments for the vertical and horizontal movement of the work roll bearings, the abutments being arranged so that when the bearings abut them, slides on the bearings align with guides extending parallel to the axes of the rolls, and the work rolls can be withdrawn from the stand along these guides.

6. A stand as claimed in claim 5, wherein the parallel extending guides are continued on a flap or flaps which, when the stand is to be put into rolling operation, can be pivoted so as to form thrust abutments for the extreme ends of the work rolls.

* * * * *